US009516442B1

(12) United States Patent
Dusan et al.

(10) Patent No.: US 9,516,442 B1
(45) Date of Patent: Dec. 6, 2016

(54) DETECTING THE POSITIONS OF EARBUDS AND USE OF THESE POSITIONS FOR SELECTING THE OPTIMUM MICROPHONES IN A HEADSET

(71) Applicant: Apple Inc., Cupertino, CA (US)

(72) Inventors: Sorin V. Dusan, Cupertino, CA (US); Alexander Kanaris, San Jose, CA (US); Aram M. Lindahl, Menlo Park, CA (US)

(73) Assignee: Apple Inc., Cupertino, CA (US)

( * ) Notice: Subject to any disclaimer, the term of this patent is extended or adjusted under 35 U.S.C. 154(b) by 148 days.

(21) Appl. No.: 14/160,427

(22) Filed: Jan. 21, 2014

Related U.S. Application Data

(63) Continuation of application No. 13/708,426, filed on Dec. 7, 2012, now abandoned.

(60) Provisional application No. 61/707,739, filed on Sep. 28, 2012.

(51) Int. Cl.
*H04R 29/00* (2006.01)

(52) U.S. Cl.
CPC ..... *H04R 29/001* (2013.01)

(58) Field of Classification Search
None
See application file for complete search history.

(56) References Cited

U.S. PATENT DOCUMENTS 5,692,059 A * 11/1997 Kruger ..... H04R 1/1016 381/151
6,178,248 B1 * 1/2001 Marash ..... H03H 21/0012 381/92
8,243,946 B2 8/2012 Burge et al.
8,718,305 B2 * 5/2014 Usher ..... H03G 3/32 381/312
9,025,782 B2 * 5/2015 Visser ..... H04R 3/005 381/23.1
2002/0198705 A1 12/2002 Burnett
2003/0165246 A1 * 9/2003 Kvaloy ..... H04R 1/1016 381/312
2003/0179888 A1 9/2003 Burnett et al.
2004/0196992 A1 * 10/2004 Ryan ..... H04R 1/10 381/312
2009/0003622 A1 * 1/2009 Burnett ..... H04R 3/005 381/92
2009/0010456 A1 * 1/2009 Goldstein ..... H04R 25/02 381/110
2009/0226013 A1 * 9/2009 Burge ..... H04R 1/1041 381/309

(Continued)

OTHER PUBLICATIONS

Falk et al "Augmentative Communication Based on Realtime Vocal Cord Vibration Detection." IEEE Transactions on Neural Systems and Rehabilitation Engineering, vol. 18 No. 2, Apr. 2010. pp. 159-163.*

(Continued)

*Primary Examiner* — Quoc D Tran
*Assistant Examiner* — Qin Zhu
(74) *Attorney, Agent, or Firm* — Blakely, Sokoloff, Taylor & Zafman LLP

(57) ABSTRACT

Embodiments of the invention determine whether speaker earbuds of a headset are positioned in a user's ears. The headset may be a "Y" shaped headset with two earbuds having speakers and a plug for insertion into a jack of the audio device. Multiple microphones are located on wired lengths to the earbuds and a common wire between the lengths and the plug, to receive speech from the user's mouth. Each earbud may have a front and rear microphone, and an accelerometer. Embodiments can detect user speech vibrations at one or more of the microphones, and in the accelerometers in the earbuds. Based on these detections, it can be determined whether one or both of the earbuds are in user's ears. To provide more accurate beamforming, when only one of the earbuds is in the user's ears, only the microphones leading to that earbud are selected for beamforming input.

26 Claims, 8 Drawing Sheets

(56) References Cited

U.S. PATENT DOCUMENTS

| | | | | |
|---|---|---|---|---|
| 2010/0020998 | A1* | 1/2010 | Brown | H04R 1/1041 381/380 |
| 2010/0098261 | A1* | 4/2010 | Norhammar | H04M 1/6066 381/59 |
| 2011/0026722 | A1* | 2/2011 | Jing | G10L 21/0208 381/71.1 |
| 2011/0135120 | A1 | 6/2011 | Larsen et al. | |
| 2011/0222701 | A1 | 9/2011 | Donaldson et al. | |
| 2011/0228950 | A1 | 9/2011 | Abrahamsson et al. | |
| 2012/0058803 | A1 | 3/2012 | Nicholson | |
| 2012/0114132 | A1* | 5/2012 | Abrahamsson | H04R 1/1016 381/74 |
| 2012/0114154 | A1* | 5/2012 | Abrahamsson | H04R 5/033 381/309 |
| 2012/0189136 | A1* | 7/2012 | Brown | H03G 3/20 381/74 |
| 2013/0202132 | A1* | 8/2013 | Zurek | H04M 1/605 381/107 |
| 2013/0279724 | A1* | 10/2013 | Stafford | H04R 1/1041 381/309 |

OTHER PUBLICATIONS

Matic, Aleksandar et al. "Speech activity detection using accelerometer." Aug. 28-Sep. 1, 2012. pp. 1-4. 34th Annual International Conference of the IEEE EMBS.*

Apple Inc., U.S. Appl. No. 13/631,716, filed Sep. 28, 2012.

Dargie, Waltenegus; "Analysis of Time and Frequency Domain Features of Accelerometer Measurements"; Fac. of Comput. Sci., Tech. Univ. of Dresden, Dresden, Germany.

Dusan, et al., "Speech Coding Using Trajectory Compression and Multiple Sensors", Interspeech , ISCA, (2004).

Dusan, et al., "Speech Compression by Polynomial Approximation", IEEE Transactions on Audio, Speech & Language Processing, (2007).

* cited by examiner

DETECTING THE POSITIONS OF EARBUDS AND USE OF THESE POSITIONS FOR SELECTING THE OPTIMUM MICROPHONES IN A HEADSET

This application is a continuation of Ser. No. 13/708,426 filed Dec. 7, 2012, entitled "Detecting the Positions of Earbuds and Use of These Positions For Selecting The Optimum Microphones in a Headset", currently pending, which is a non-provisional application claiming the benefit of U.S. Provisional Application No. 61/707,739, filed Sep. 28, 2012.

FIELD

An embodiment of the invention relates to electronic audio devices and determining whether earbuds of a headset are positioned in ears of a user based on detecting a user's voice at microphones and accelerometers of the headset. Based on the determination, certain microphones of the headset may be selected for user beam forming data input. Other embodiments are also described.

BACKGROUND

Audio systems such as consumer electronic audio devices including desktop computers, laptop computers, pad computers, smart phones and digital media players have a headphone or earphone jack through which the portable device can interface with an accessory device, such as a directly powered headset. The typical headset may have a "Y" shape with two earbuds at the top of two wired lengths that have their bottom ends joined at the top of a common wire, the common wire having a plug for insertion or "plugging" into the jack at the other end. Each earbud has a speaker to provide audio output to the user's ears. The more recent headset may also have multiple integrated microphones located in the earbuds, along the wired lengths, and along the common wire to receive audio input from the user's mouth.

An audio integrated circuit referred to as an audio codec may be used within the audio device, to output audio to the headset when it is plugged into the headphone jack. In addition, the audio codec also includes the capability of receiving audio signals from the microphones. The audio codec is typically equipped with several such audio input and output channels, allowing audio to be played back through either earpiece and to be received from any of the microphones.

However, under typical environmental conditions, the microphones may do a poor job of capturing a sound of interest (e.g., speech received from a user's mouth) due to the presence of various background sounds. So, to address this issue many audio devices often rely on noise reduction, suppression, and/or cancellation techniques. One commonly used technique to improve signal to noise ratio is audio beamforming. Audio beamforming is a technique in which sounds received from two or more microphones are combined to enable the preferential capture of sound coming from certain directions. An audio device that uses audio beamforming can beamform using two or more closely spaced, omnidirectional microphones linked to a processor. The processor can then combine the signals captured by the different microphones to generate a single output to isolate a sound from background noise.

SUMMARY

Embodiments of the invention include an audio device determining whether speaker earbuds of a headset are positioned or inserted in ears of a user. The determination may include detecting user speech vibrations in accelerometers in the earbuds. The headset may be a "Y" shaped headset with two earbuds at the top end of two wired lengths that have their bottom ends joined at the top of a common wire having a plug at the other end for insertion into a jack of an audio device. Each earbud has a speaker to provide audio output to the user's ears. The headset may also have multiple microphones located in the earbuds, along the wired lengths, and/or along the common wire, to receive audio input from the user's mouth (e.g., speech). Each earbud may have a front microphone, a rear microphone, and an accelerometer.

The audio device can detect user speech vibrations at the microphones. This may include filtering to pass only frequencies of sound for speech, and/or using microphone based voice activity detection (VAD) in order to provide a microphone voice activity detection output signal. The device can also detect the user speech vibrations in the accelerometers in the earbuds in order to provide an accelerometer based voice activity detection output signal. This may include using a "custom" voice vibration detection accelerometer, filtering out the direct current (DC) output of the accelerometers, removing cross talk at the accelerometers that is from the earbud speaker, combining various accelerometer direction magnitudes, and/or performing a normalized cross-correlation between a pair of orthogonal accelerometer output signals.

Based on these detections, it can be determined whether one or both of the earbuds are in ears of the user. Determining whether earbuds of a headset are in ears of a user may include combining (such as by logical AND) one or more of the accelerometer voice activity detection outputs with the microphone voice activity detection output from one or more of the microphones (optionally including the microphones in the earbuds). It may also include determining if the power ratio between the front and rear microphone in a high frequency region is above a threshold in each earbud.

If only one earbud is determined to be in the user's ears, the audio device may select one or more of the microphones of the wired length to the earbud in the user's ear as data inputs to perform beamforming. The microphones along the common wire and/or in that earbud may also be used. The microphones of the earbud that is not in the user's ear and of the wired length to that earbud may not be used or selected as data inputs to perform beamforming. This leads to more accurate detection (e.g., as compared to those methods which are based on gravitation) of which earbuds are in the user's ear and to more accurate user voice beamforming. For example, this method based on voice detection in accelerometers can be used even if the user is lying down, a case in which the gravitation-based methods would fail to detect that the earbuds are in user's ears.

The above summary does not include an exhaustive list of all aspects of the present invention. It is contemplated that the invention includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

BRIEF DESCRIPTION OF THE DRAWINGS

The embodiments of the invention are illustrated by way of example and not by way of limitation in the figures of the accompanying drawings in which like references indicate similar elements. It should be noted that references to "an" or "one" embodiment of the invention in this disclosure are not necessarily to the same embodiment, and they mean at least one.

DETAILED DESCRIPTION

Figure 1A:
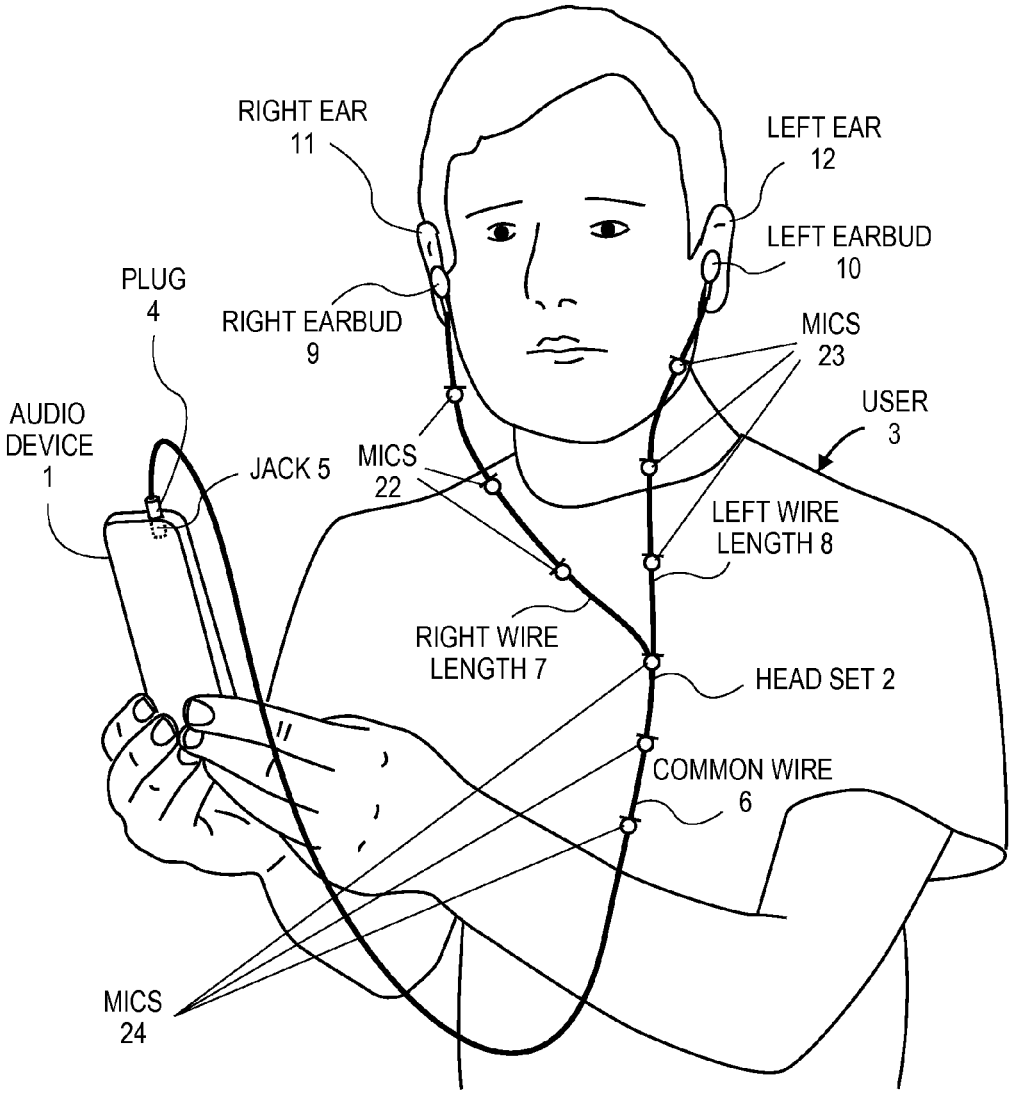
FIGS. 1A-B show a portable audio system in use while in the headphone/headset mode with both earbuds in the ears and with only the left earbud in the ear, respectively.

Several embodiments of the invention with reference to the appended drawings are now explained. While numerous details are set forth, it is understood that some embodiments of the invention may be practiced without these details. In other instances, well-known circuits, structures, and techniques have not been shown in detail so as not to obscure the understanding of this description.

Embodiments of the invention relate to determining whether one or two earbuds of a headset are positioned (e.g., inserted) in ears of a user based on detecting a user's voice at microphones and/or accelerometers of the headset. For instance, some embodiments include detecting the relative position and/or orientation of microphones in headsets containing two earbuds and multiple microphones distributed across the earbuds and the wires of the headset. Such headsets may have three wires as schematically represented by the letter "Y" (a left-side wire connecting the left earbud; a right-side wire connecting the right earbud; and a common wire joining the previous two) and a plug for connecting the headset to the communication or audio device (e.g., phone, tablet, computer, etc.). Each earbud, corresponding wire (left or right), and the common wire may contain a number of microphones (in the earbud and on the wires).

In some embodiments, when both earbuds are in the ears of the user the vibrations generated by the vocal cords (e.g., voice) of the user during speech activity can be captured by both accelerometers placed in both of the earbuds. In this case the microphones distributed in both left and right earbuds and left, right, and vertical wires may be used to capture the user's speech (e.g., for user beamforming data input). In some embodiments, when the vibrations determine that the left earbud is not in the user's ear but the right earbud is, then only the microphones distributed on the right earbud and right and vertical wires will be used to capture the user's speech since the positions of the left earbud and left wire are unknown and likely farther away from the user's mouth in this case. In some embodiments, when the vibrations determine that the right earbud is not in the user's ear but the left one is then only the microphones distributed on the left earbud and left and vertical wires will be used to capture the user's speech since the positions of the right earbud and right wire are unknown and likely farther away from the user's mouth in this case.

Some embodiments for detecting if the earbuds are in the user's ears, which use the detection of the speech vibrations (e.g., at accelerometers) may be more accurate than those methods which are based on gravitation. For example, detecting speech vibrations may be more accurate because it does not suffer from errors that occur when gravitational based detection erroneously detects: (1) that an earbud is in the use in the ear but, in fact the headset is hanged in a vertical position on an object and the earbud is not in the ear, and (2) that an earbud is not in the use in the ear but, in fact the earbud is in the ear, and the user is lying down.

Accurately determining which earbud is positioned in the user's ear (e.g., whether one or both are inserted) may help the selection of the appropriate microphones from the headset for audio input and for the creation of the optimal user speech beam forming using these microphones. Such determining may lead to more accurate detection of the existence of user speech (e.g., such as better VAD), more accurate detection of the direction of user speech (e.g., direction of a user's mouth with respect to the microphones), and more accurate beamforming (e.g., capturing of sound in the direction of a user's mouth with respect to the microphones).

Figure 1B:
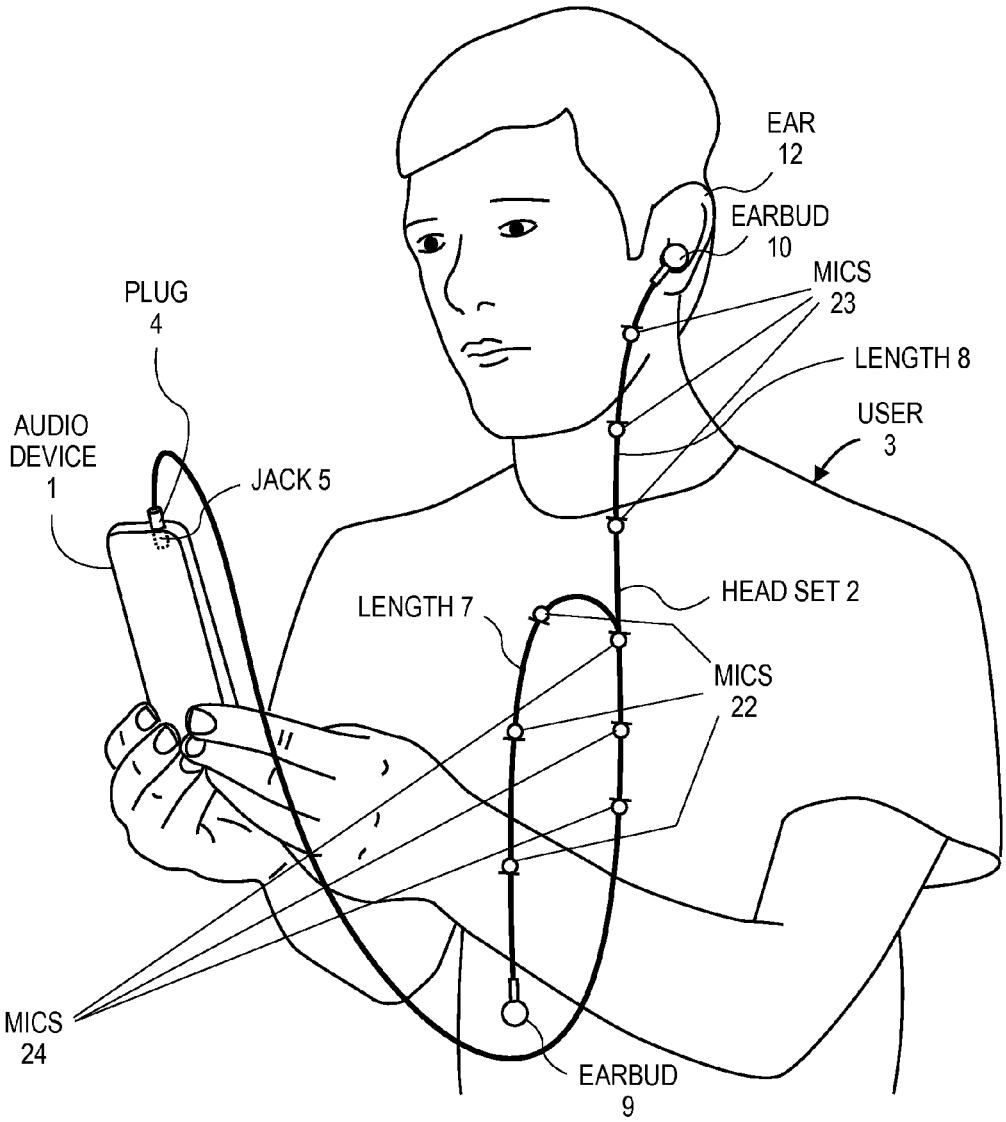

FIGS. 1A-B show a portable audio system in use while in the headphone mode. FIG. 1A shows an audio system including audio device 1 and headset 2, being used by user 3. Plug 4 of the headset is inserted into headset jack 5 of device 1. For instance device 1 may have a housing in which accessory connector 5 (e.g. a headphone or earphone "jack"), is integrated. The headset may have a "Y" shape formed by common wire 6, right wired length 7 and left wired length 8. Right wired length 7 and left wired length 8 are attached to right earbud 9 and left earbud 10, which in FIG. 1A are shown inserted into right ear 11 and left ear 12 of user 3.

Wire 6 is attached to plug 4 and lengths 7 and 8 to provide signals (e.g., audio and data) between plug 4 and one end of wired lengths 7 and 8 and left wired length 8. Wire 6 is also attached to plug 4 to provide signals (e.g., audio and data) between wire 6 and plug 4. Lengths 7 and 9 are attached at one end to earbuds 9 and 10 to provide signals (e.g., audio and data) between the earbuds and wire 6.

FIG. 1B shows an audio system including audio device 1 and headset 2, being used by user 3. As compared to FIG. 1A, FIG. 1B only shows left earbud 10 inserted into left ear 12 of user 3 (e.g., oriented "upward"). Right earbud 9 is not inserted into right ear 11. Instead, right earbud 9 and length 7 are shown dangling or hanging down farther from the user's mouth (e.g., oriented "downward"). FIGS. 1A and 1B show right wire length microphones 22 located along length 7, left wire length microphones 23 located along common length 8, and common wire microphones 24 located along common wire 6.

Figure 2A:
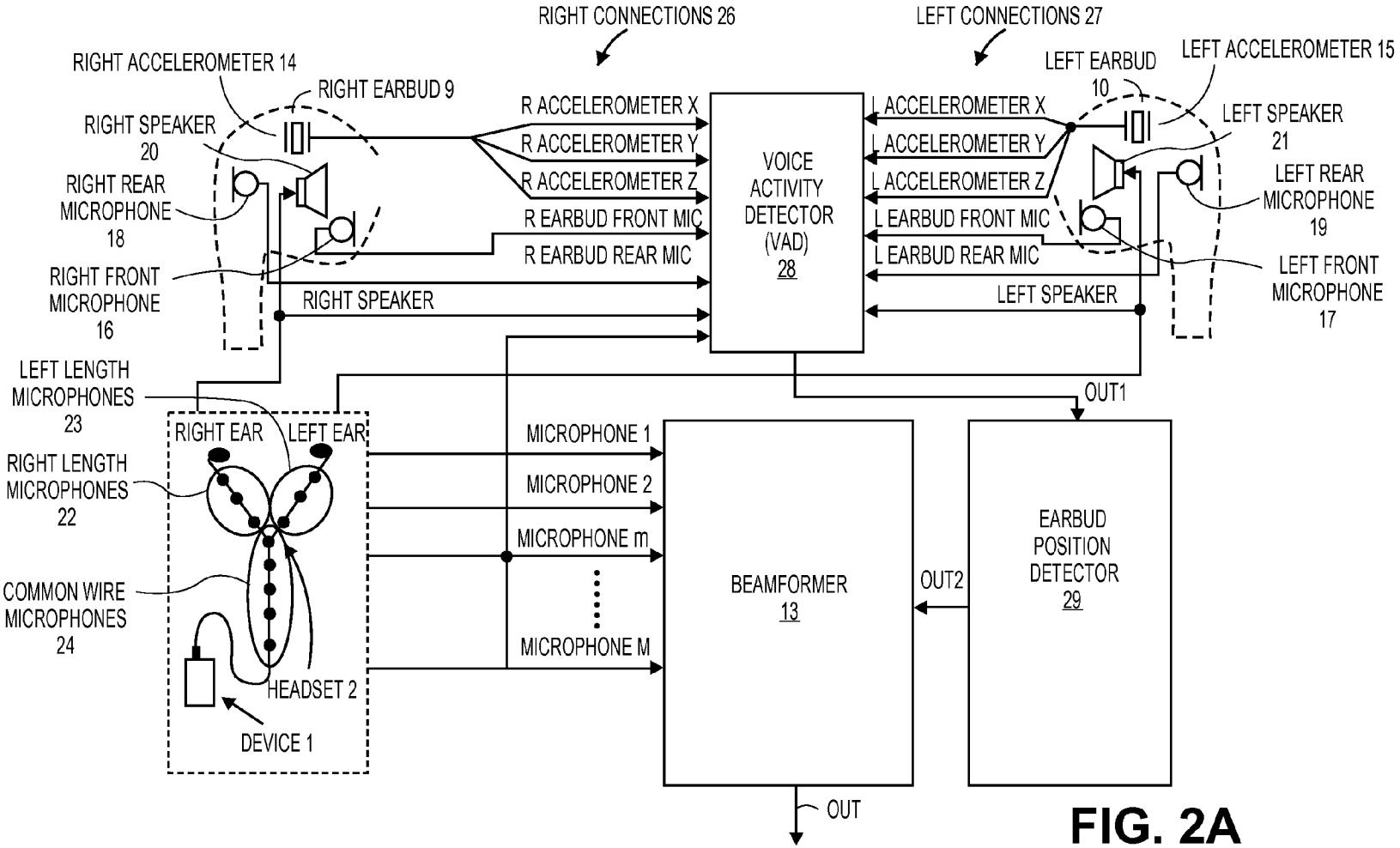
FIGS. 2A-B show block diagram and circuit schematic of relevant portions of the audio system for determining whether earbuds of a headset are inserted in ears of a user.
Figure 2B:
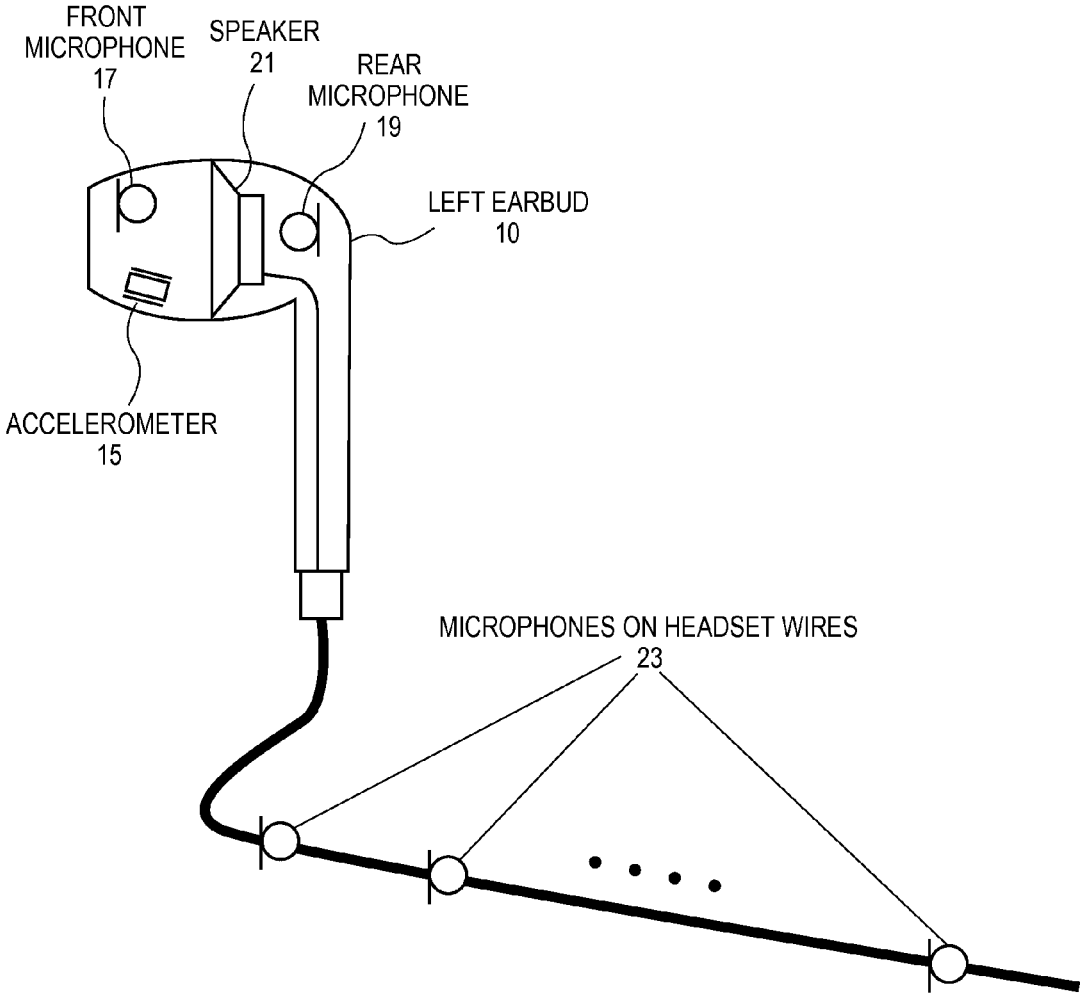

FIGS. 2A-B show hybrid block diagrams, cross sectional views and circuit schematics of relevant portions of the audio system for determining whether earbuds of a headset are inserted in ears of a user. Right wire length microphones 22 are shown located along length 7; and left wire length microphones 23 are shown located along common length 8. According to embodiments, there may be between 1 and 5 microphones located along each. In some cases, there is just one microphone on each length. In other cases there are 2, 3, 4 or 5 on each length. In some cases, they are spaced evenly along a portion of the length, or along the entire length. In some cases they are not spaced evenly. Length 7 includes wires or connections attached to microphones 22 to provide signals (e.g., audio) from the microphones to wire 6. Also, length 8 includes wires or connections attached to microphones 23 to provide signals (e.g., audio) from the microphones to wire 6.

Common wire microphones 24 are shown located along common wire 6. There may be between 1 and 10 microphones located along wire 6. In some cases, there is just one microphone on the wire. In other cases there are 2, 3, 4 or up to 10 on the wire. In some cases, they are spaced evenly along a portion of or along the entire wire. In some cases they are not spaced evenly. In one case, there may only be one microphone on the wire. In this case, that microphone, and/or another microphone on the headset may be used to detect the user's voice. Wire 6 includes wires or connections attached to microphones 24, length 7 and length 8 to provide signals (e.g., audio) from the microphones to wire plug 4.

FIGS. 2A-B show right earbud 9 having right accelerometer 14, right front microphone 16, right rear microphone 18, and right speaker 20. Left earbud 10 is shown having left accelerometer 15, left front microphone 17, and left rear microphone 19, and left speaker 21. For instance, FIG. 2B shows a cross section and circuit diagram configuration of components 15, 17, 19, 21 and 23 for left earbud 10. The configuration of FIG. 2B may be repeated in a mirror like fashion to provide a diagram of components 16, 18, 20 22 and 24 for right earbud 9.

FIG. 2A shows right connections 26 (e.g., wires, possibly traces and the like) attached to right accelerometer 14 and VAD 28 to provide signals (e.g., data) from accelerometer 14 to VAD 28. In some case, these connections include a right accelerometer X, Y, and Z coordinate axes connection. FIG. 2A also shows left connections 27 attached to left accelerometer 15 and VAD 28 for a similar purpose (e.g., having a similar structure and capability as the right side).

FIG. 2A shows right connections 26, attached to right front microphone 16, right rear microphone 18, and VAD 28 to provide signals (e.g., audio) from the microphones 16 and 18 to VAD 28. FIG. 2A also shows left connections 27, such as wires, attached to left front microphone 17, left rear microphone 19, and VAD 28 to provide signals (e.g., audio) from the microphones 17 and 19 to VAD 28. Some of these cases are explained further below, such as at block 33 of FIG. 3.

FIG. 2A shows right connections 26 attached to microphones m and VAD 28 to provide signals (e.g., audio) from microphones m to VAD 28. In some case, these connections include connections to all of the microphones in wire 6, and lengths 7 and 8.

Figure 3:
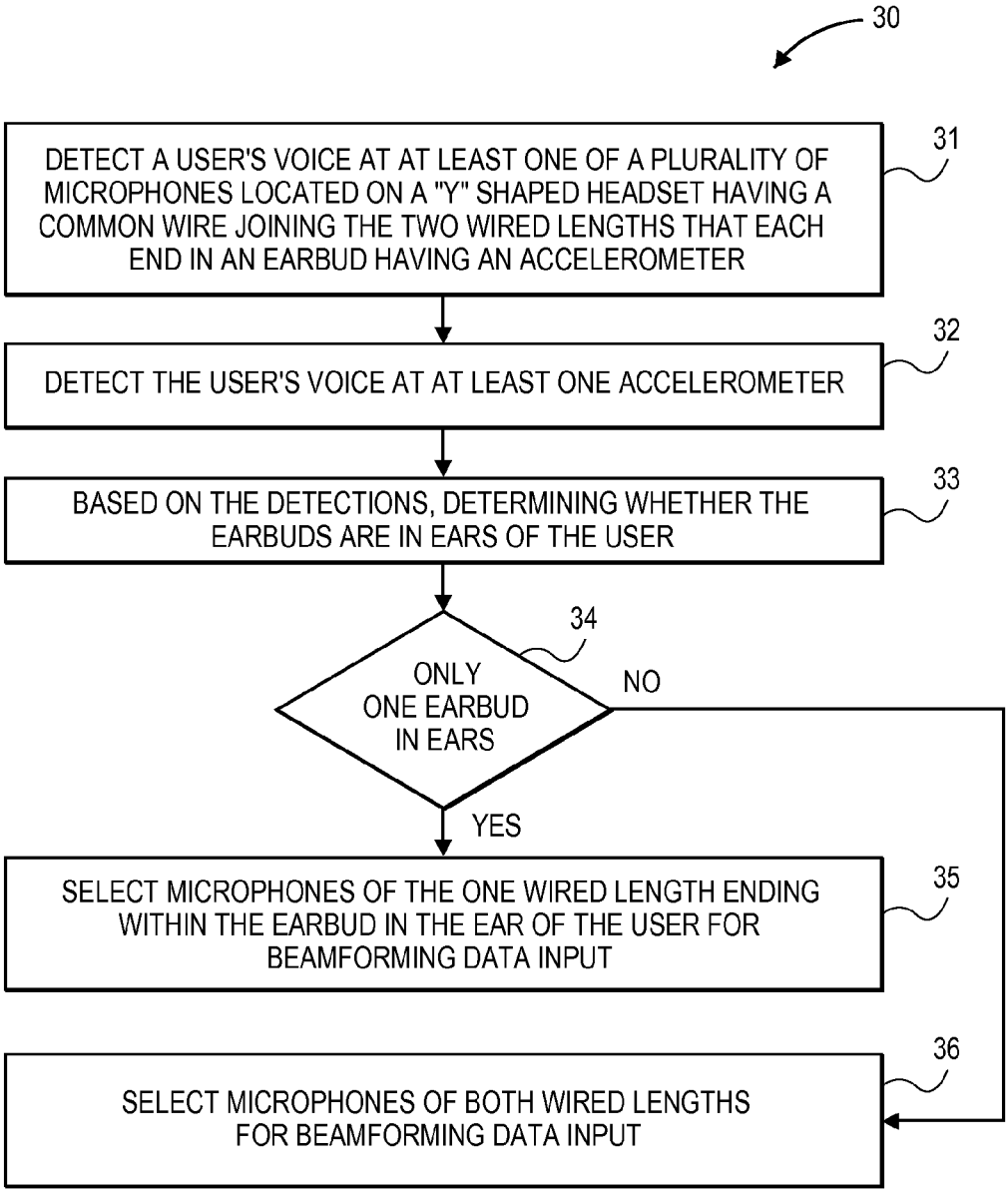
FIG. 3 is a flow diagram of an example process for determining whether earbuds of a headset are inserted in ears of a user.

VAD 28 may be used to perform microphone voice activity detection noted herein, such as at block 31 of FIG. 3 and accelerometer voice activity detection such as at block 32 of FIG. 3. In some embodiments VAD 28 may also be used to perform part of block 33. VAD is shown having output OUT 1 to detector 29. This output may be used to provide the detector with a combination of the microphone voice activity detection output and the accelerometer voice activity detection output signals or binary detection output, such as noted below.

Detector 29 may be used to perform earbud position detection noted herein, such as at block 33 of FIG. 3. In some cases detector 29 may also be used to perform block 34 and 36. In addition, in some cases detector 29 may also be used to perform or send signals to beamformer circuitry 13 to cause it to perform blocks 35 and 37. Detector 29 is shown having output OUT 2 to beamformer circuitry 13. This output may be used to provide beamformer circuitry 13 with a signal indicating whether one (e.g., left or right) or both earbuds are positioned in the ears of the use. Detector 29 may also have an output to a processor and/or audio codec of device 1, such as to send a signal indicating whether any of earbuds are positioned in the ears of the use. This signal may also be used to cause the processor or audio codec to perform parts of blocks 35 and 37, such as to select only certain microphones (e.g., of the one earbud in the ears of the user and the one wired length ending with that one earbud) for user voice audio input for beamforming.

According to some embodiments, earbud position detector 29 receives a signal on OUT1 from the VAD block 28 which is a combination of microphone-VAD and accelerometer-VAD. Based on this combined signal the detector 29 may make a decision (e.g., by sending a signal on OUT2 to beamformer 13) to ONLY eliminate the microphones from the wire whose earbud is not in the ear for beamforming. In some embodiments, this decision does not extend to the case when zero earbuds are detected in the ears. In some cases, the signal sent on OUT 2 specifies to only select left wire microphones, or right wire microphones, or both left and right wires microphones (plus possibly the common wire microphones which can be selected all the time). For example, OUT2 can have three levels: 0=select both left and right; 1 select right only; 2 select left only.

Beamformer 13 may be circuitry to provide beamforming as known in the art and/or as described herein. According to embodiments, this beamforming may only use the microphones of the headset selected for beamforming data input, as described herein. This may include beamforming as described for blocks 35 and 36.

In some cases, wire 6, or one of length 7 or 8 includes a microphone button, such as to initiate and/or end a phone call. The button may be connected to the plug by a separate connector or wire; or may be connected through one of the connections noted above.

The accelerometers may be used to detect motion, movement, and vibration of each earbud in one or more dimensions. In some cases, each accelerometer may be able to detect (e.g., provide a vibration derived output caused by) speech or voice caused vibrations of each earbud in one or more dimensions. Further embodiments are described below.

The audio device 1 can be "playing" any digital or analog audio content through the headset 2 (e.g., through one or both speakers to the user's respective ears), including, for instance, a locally stored media file such as a music file or a video file, a media file that is streaming over the Internet, and the "downlink" speech signal in a two-way real-time communications session, also referred to as a telephone call or a video call. Such playing may be as known in the art.

The microphones located on the earbuds, wired lengths, and/or common wire may receive (e.g., "detect") audio input or "uplink" signals from the user's mouth. The input may be converted to analog or digital signal output. This may include vocal sounds from the user's mouth (e.g., "user speech"). In some cases beamforming may be used to locate or detect the direction of the user's voice (e.g., and improve signal to noise ratio). In some cases all of the microphones are used to receive or detect user speech and/or to beamform. In some cases, use of the term "uplink" may refer to recording, sending or transmitting audio (e.g., speech, sounds, or music previously recorded or streamed live) received from or through one or more of the device microphones. In other cases only a portion of, a subset of, or fewer than all of the microphones are used (e.g., selected) to detect the user's voice and/or to beamform. An audio codec may be used when providing such downlink and uplink capabilities.

FIG. 3 is a flow diagram of an example process for determining whether earbuds of a headset are inserted in ears of a user. FIG. 3 shows process 30 wherein embodiments described herein. Process 30 starts with block 31 where a user's voice is detected at at least one of a plurality of microphones located on a Y shaped headset having a common wire joining the two wired lengths that each end in an earbud having an accelerometer. The detection may occur at any single one, or any number of the microphones located at any one or more of the wired lengths, column wire, or earbuds. Block 31 may include detecting the user's voice using, by, or with the at least one of a plurality of microphones. Block 31 may include descriptions herein for detecting speech or a voice at a microphone. In some cases, block 31 includes removing frequencies of data that do not represent vibration at a frequency typical for a user's speech. The microphones may be acoustic microphones that use a diaphragm to sense sound pressure in or traveling through air. The microphones may sense sound by being exposed to outside ambient. In some cases, they may sense sound without (and not by) sensing vibration or movement in a sealed chamber, or with a suspended mass in such a chamber.

In some embodiments, next, cross talk from output of the speaker is removed from the microphone response, such as is known in the art. This may include removing an "echo" or other audio that is known to being output by the speaker, such as resulting from download, music, or other audio played out of the ear bud for the user to hear. Since these audio signals are already known by device 1 or the headset, known processes or circuitry can be used to remove them (e.g., "cross talk") from the output of the microphones.

Block 31 may include performing user voice activity detection (VAD) with the microphone data to detect the user's voice, such as by determining that the user is speaking based on frequencies and amplitudes of audio detected by the microphone. In some cases, such VAD may include detecting the presence of the user's voice at at least one microphone on one of the lengths, and/or in one of the earbuds at the end of that length. Performing VAD may include determining a noise level and user voice activity detection based on audio signals received by multiple microphones on one of the lengths, and/or in one of the earbuds at the end of that length. Such filtering may be provided by the microphone, headset, or device 1. In one embodiment, a microphone selector can be used to compare the power of signals from multiple microphones (e.g., after filtering to pass speech) and select the microphone with the strongest power for performing the VAD.

Figure 4A:
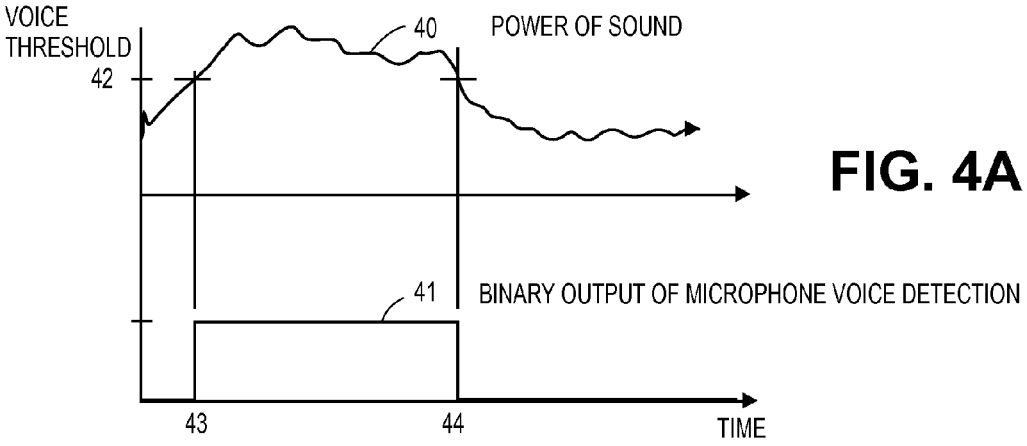
FIG. 4A shows a plot of power or square root of power of a sound and a plot of binary output of microphone voice detection over time.

In some cases, next, the power or square root of power of sound of the microphone is compared to a threshold, such as to provide a binary output of whether it is above or below a microphone "voice threshold". FIG. 4A shows power of sound plot 40 and binary output of microphone voice detection plot 41 with respect to time. When power of sound plot 40 is above "voice threshold" 42, such as happens between time 43 and 44, the binary output indicates microphone voice detection, such as detecting a voice of the user. Threshold 42 may be selected based on experiments and/or hysteresis during use to provide voice detection only when signal 40 displays significant energy, such as the case when the user is speaking. In some cases, performing microphone VAD (e.g., to produce signal 41) may include performing VAD using one or more microphones, by themselves, such as is know in the art. According to embodiments, determining power of sound 40, determining output 41, and/or block 31 may be performed by microphone voice detection circuitry. This circuitry may be part of detector 28. This circuitry may include hardware logic and/or software.

After block 31, process 30 continues to block 32 where the user's voice is detected at at least one accelerometer in an earbud. Block 32 may include descriptions herein for detecting speech or a voice at an accelerometer in the earbud being determined to be in or out of the user's ear. Block 32 may include detecting the user speech vibrations in the accelerometer, using a "custom" voice vibration detection accelerometer, filtering out the direct current (DC) output of the accelerometer, removed cross talk from output of the speaker, and/or combining various accelerometer directions or dimensions. One way of combining various accelerometer dimensions is by summing the X, Y, and/or Z-direction signals of the accelerometer and then computing its power or magnitude signal to determine the amount of vibration. If this power is above a threshold the accelerometer VAD signal is set to 1 to indicate the presence of user's voice. This VAD may be sensitive to artifacts due to movements of the earbud/user. Another way of combining various accelerometer dimensions and computing the accelerometer VAD is by performing the normalized cross-correlation between any pair of accelerometer signals (e.g., X and Y, X and Z, Y and Z) to determine the amount of correlation between two dimensions. When the normalized cross-correlation exceeds a threshold within a short delay interval the accelerometer VAD is set to 1 to indicate the presence of user's voiced speech. This process provides robustness to artifacts due to movement of the user and earbuds. In some cases, these processes reduce false detections of earbuds in the ear caused by movement of the user, by more accurately detecting periodic vibrations of the accelerometers caused by a user's voice while the earbud is in the user's ear, than by other processes. These processes will be explained further below. Block 32 may include filtering the accelerometer output to pass only frequencies of sound for speech. Block 32 may include detecting the user's voice using, by, or with the at least one accelerometer. The accelerometer may be located in, disposed in, or within the earbuds.

Figure 4B:
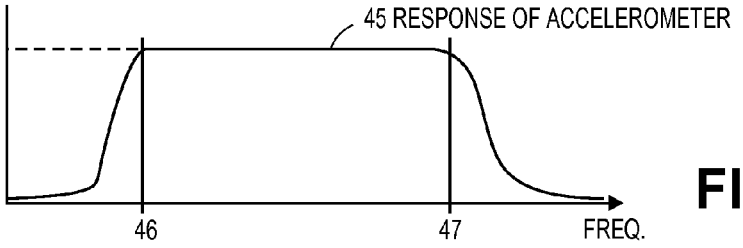
FIG. 4B shows a plot of a response versus frequency for embodiments of a "custom" accelerometer for detecting a voice of a person.

In some cases, Block 32 includes removing a DC component from the accelerometer data. This may include filtering (e.g., high pass filtering) to remove any vibration or accelerometer components below 70 Hz (e.g., frequency 46 as shown in FIG. 4B). This may include filtering to remove any components between DC and 70 Hz. This may help reduce or remove frequency components or noise that is below the useful frequencies for detecting human speech. Such speech components (pitch fundamental) are usually at frequencies above 80 Hz for a male, and above 160 Hz for a female. This may also help remove frequency components or noise caused by typical alternating current power sources (e.g., around 50 or 60 Hz) such as that generated by motors, lights, and other electronic components (e.g., powered from a wall outlet). In some cases, a "custom" accelerometer for detecting a voice of a person may include such a filter or may only have a response (e.g., amplitude) versus frequency that passes signal above such ranges. In some cases, this includes removing frequencies of data that represent movement of the accelerometer and a direction. In some cases, this includes removing frequencies of data that do not represent vibration at a frequency typical for a voice of a person.

In some cases, the accelerometer may be a "custom" accelerometer that detects a voice by migration in one, two, or three dimensions. In some cases, the accelerometer includes a mass sealed in a chamber, with the mass moves with respect to the walls of the chamber, when the chamber is moving. The mass may detect vibration, regardless of gravitational forces or orientation with respect to gravity or the direction of the vibration. In some cases, accelerometer senses vibration without (and not by) sensing sound by being exposed to outside ambient air (e.g., outside of the sealed chamber); or sensing sound pressure in or traveling through air.

The accelerometer may have a bandwidth between 0 and 500 Hz; between 0 and 1 kHz; or between 0 and a frequency between 500 Hz and 3 kHz, (e.g., frequency 47 as shown in FIG. 4B). In some cases, a "custom" accelerometer for detecting a voice of a person may include such a filter or may only have a response (e.g., amplitude) versus frequency that passes signal within such ranges. At frequency 46 filtering provided by the accelerometer, headset, or device 1 removes DC components below a lower threshold frequency, such as described above.

FIG. 4B shows a response (e.g., amplitude) versus frequency plot for embodiments of a "custom" accelerometer for detecting a voice of a person. In FIG. 4B, response 45 represents the range of response of such a custom accelerometer. At frequency 46 filtering removes DC components below a lower threshold frequency, such as described above. At frequency 46 filtering provided by the accelerometer, headset, or device 1 removes DC components below a lower threshold frequency, such as described above.

Frequencies above frequency 47 may also be filtered out or not detected by an accelerometer, headset or device 1, such as described above. In some cases, frequency 47 represents frequency above which a custom accelerometer does not provide output for vibrations. For instance, accelerometer may be designed so that the mass within the sealed chamber does not vibrate or the accelerometer does not provide an output for frequencies above frequency 47.

Next, cross talk from output of the speaker is removed from the accelerometer response. This may include removing an "echo" or other audio that is known to be being output by the speaker, such as resulting from download, music, or other audio played out of the ear bud for the user to hear. The echo may include feedback of the user's voice coming from the speaker. Since these audio signals are already known by device 1 or the headset, known processes or circuitry can be used to remove them (e.g., "cross talk") from the output of the accelerometer. In some cases this may be done using technology similar to what is used for the microphones. It is considered that the order of filtering out the DC output of the accelerometer signals, and removing cross-talk as described above, may be reversed.

Next, one or more of the dimensions of movement of the accelerometer, vibration is converted into a magnitude or into a binary signal detecting a voice of the user. For example, according to some embodiments, the X, Y, and/or Z-direction vibration signals of the accelerometer can be converted into a power or magnitude or into a positive signal to determine the amount (e.g., energy or magnitude) of vibration in each dimension. In some cases, a signal is converted into a power or magnitude for only one dimension. In some cases, one dimension may be selected based on the accelerometer signal which shows the highest sensitivity to the user's speech. It is also considered that a one dimensional accelerometer may be used to provide a similar result. In some cases, a signal is converted into a power or magnitude for only two dimensions. It is also considered that a two dimensional accelerometer may be used to provide a similar result. In some situations, the magnitude of the vibration is converted for all three the X, Y and Z dimensional vibrations of the accelerometer. For example, in some cases, calculating the magnitude may include calculating $X^2+Y^2+Z^2$ of the magnitude components of the accelerometer output (e.g., after filtering to pass speech). It is also considered that the square root of this calculation may be used to provide a scaled magnitude. In other cases, calculating the power may include $(X+Y+Z)^2$ to calculate the sum and then the square of signals of speech vibration of the accelerometer.

Figure 4C:
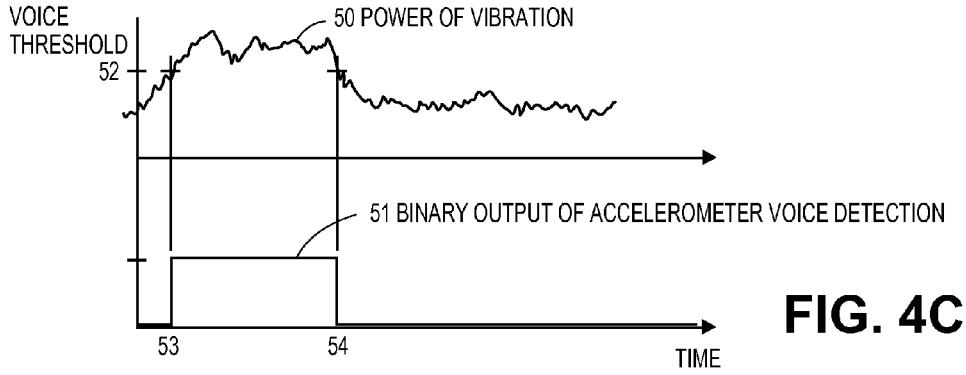
FIG. 4C shows a plot of power or square root of power of accelerometer vibration and a plot of binary output of accelerometer voice detection over time.

Next, the power or square root of power of vibration of the accelerometers may be compared to a threshold, such as to provide a binary output of whether the magnitude is above or below an accelerometer "voice threshold". FIG. 4C shows power of vibration plot 50 and binary output of accelerometer voice detection plot 51 with respect to time. When power of vibration plot 50 is above "voice threshold" 52, such as happens between time 53 and 54, the binary output indicates accelerometer voice detection, such as detecting a voice of the user. Threshold 52 may be selected based on experiments and/or hysteresis during use to provide voice detection only when signal 50 displays significant energy, such as the case when the user is speaking.

According to some embodiments, one way to convert one or more of the dimensions of movement of the accelerometer into a magnitude or into a binary signal detecting a voice of the user, is by performing the normalized cross-correlation between any pair of orthogonal accelerometer signals (e.g., X and Y; X and Z; Y and Z). The orthogonal signals may be outputs of orthogonally oriented accelerometer sensors, or may be the orthogonal outputs of a single accelerometer. While the normalized cross-correlation exceeds a threshold within a short delay interval the accelerometer VAD is set to 1 to indicate the presence of user's voiced speech. In some case, performing the normalized cross-correlation includes cross correlating orthogonal accelerometer signals of one accelerometer.

In some case, performing the normalized cross-correlation between any pair of accelerometer signals (e.g., X and Y, X and Z, Y and Z) may detect that the earbud is accelerating or vibrating in 2 dimensions in response to being shaken by the user's voice. Thus, the correlation output signal detects a level of similarity in the 2 dimensional vibration that is typical of or assumed to be cased by user speech instead of other movement (e.g., non-speech movement, coughs, scratches, etc.).

In some case, performing the normalized cross-correlation includes processing the cross correlation of normalized (and optionally filtered) output signals from any two of the three orthogonally oriented inertial sensors (e.g., X, Y and Z accelerometer outputs) to compute or calculate a cross correlation function as between the output signals over a given time interval (e.g., a short delay interval of time) that when analyzed reveals vibrations caused by the user speaking.

Performing the cross correlation may be done after filtering out the direct current (DC) output of the accelerometer signals, removing cross talk in the accelerometer signals (e.g., resulting from output of the earbud speaker), and/or normalizing the accelerometer signals. For example, filtering out the direct current (DC) output of the accelerometer signals, and removing cross talk in the accelerometer signals may be performed as described above.

According to embodiments normalizing the cross-correlation is performed such as the output is between −1 and 1. The cross-correlation is computed for a short delay interval to allow for delay differences of speech vibrations received by the accelerometer in different directions. This interval is further described, below.

It is considered that the order of filtering out the DC output of the accelerometer signals, removing cross-talk, and normalizing as described above, may be altered or reversed.

Figure 4D:
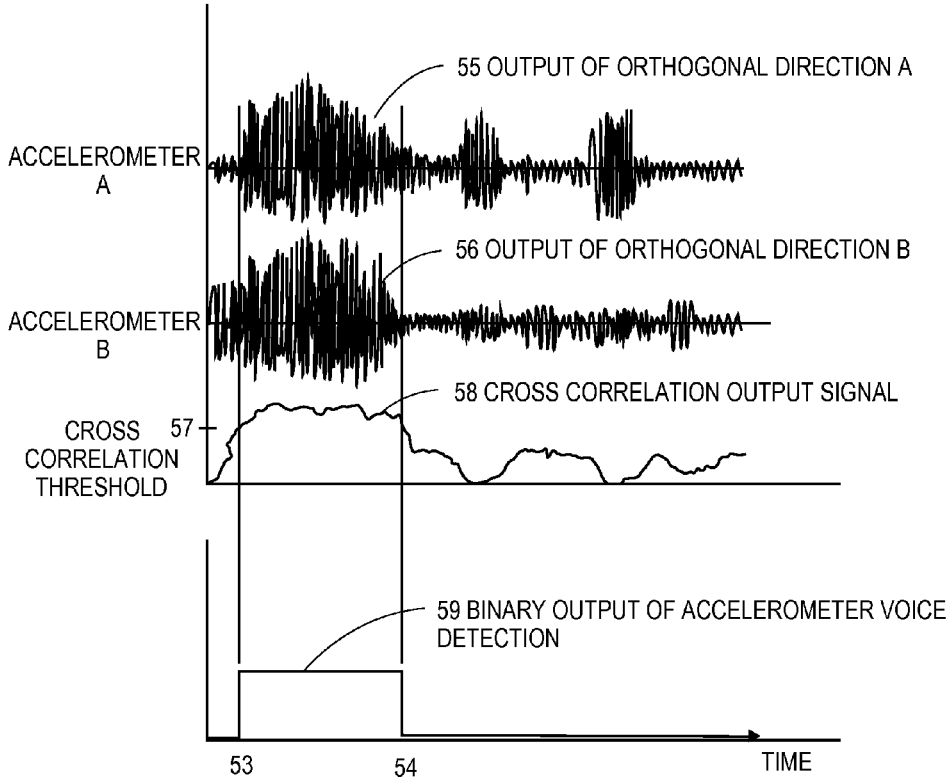
FIG. 4D shows accelerometer signals for orthogonal directions with respect to time; cross correlation output of the signals; and binary output of accelerometer voice detection over time.

FIG. 4D shows accelerometer signals (optionally filtered) for orthogonal directions A and B with respect to time. It can be appreciated that A and B represent any two orthogonal directions or accelerometer outputs, such as any pair of X and Y; X and Z; or Y and Z. FIG. 4D shows accelerometer output 55 of orthogonal direction A, and accelerometer output 56 of orthogonal direction B.

FIG. 4D also shows normalized cross correlation output signal 58 produced by cross correlating signals 55 and 56; and binary output of accelerometer voice detection plot 59 with respect to time. In some cases, output signal 58 is the cross correlation of signals 55 and 56 at time offset, or lag between zero and a short delay value d. In some cases, output signal 58 is the cross correlation of signals 55 and 56 by performing a cross correlation as described herein, and/or as known in the art.

According to embodiments, performing the normalized cross-correlation between any pair of accelerometer signals (e.g., X and Y, X and Z, Y and Z) may include calculating the measure of similarity of the two orthogonal accelerometer signal waveforms as a function of a time-lag applied to one of them. It may include calculating the sliding dot product or sliding inner-product of the waveforms.

According to embodiments, output signal 58 may be the normalized cross-correlation during a short delay interval d, such as 10 or 20 samples.

When cross correlation output signal 58 is above "cross correlation threshold" 57, such as happens between time 53 and 54, the binary output 59 indicates accelerometer voice detection, such as detecting a voice of the user. Threshold 57 may be selected based on experiments and/or hysteresis during development and/or use to provide voice detection only when signal 58 displays significant correlation between the vibrations of the normalized (and optionally filtered) accelerometer signals for orthogonal directions, such as the case when the user is speaking.

According to embodiments, setting the accelerometer VAD to 1 to indicate the presence of user's voiced speech may include continually comparing the cross correlated output signal to a threshold over, for, and/or during a predetermined short delay interval of time. Output 59 may indicate detecting the user's voice (e.g., by being an accelerometer VAD high or 1) while the cross correlated output signal exceeds a threshold.

According to embodiments, determining power of vibration 50, determining output 51, output 58, signal 59, and/or block 32 may be performed by accelerometer voice detection circuitry. This circuitry may be part of detector 29. This circuitry may include hardware logic and/or software.

After block 32, process 30 continues to block 33 where it is determined whether the earbuds are in the ears of the user. This may include determining whether only one (e.g., left or right) or two earbuds are positioned in the ears of the user. The determination may be based on detecting simultaneously the user's voice at one or more microphones, and at at least one accelerometer. Such determinations may be based on detecting the user's voice at only one microphone and at one accelerometer. In some cases, this determination may be made based only the detection of the user's voice at one or more accelerometers. In some cases, this determination may be to determine whether the right earbud is in the ear of the user, but the left earbud is not. In other cases, this determination may be to determine whether the left earbud is in the ear of the user, but the right earbud is not. In other cases, this determination may be to determine whether both earbuds are in the ears of the user. The case when neither earbud is in the ear of the user is not determined based on the combined audio VAD and accelerometer VAD.

Block 33 may include combining any one or more of the accelerometer voice detection binary outputs (e.g., such as shown by output 51 or 59) with the voice detection binary output from any one or more of the microphones (e.g., such as shown by output 41) along the same wired length or at the microphones in the earbuds. In some cases, block 33 includes combining only one microphone voice detection binary signal and only one of the accelerometer voice detection binary signals (e.g., 51 or 59). In some embodiments, block 33 may include combining more than one microphone voice detection binary signals (e.g., each one similar to 41) and only one of the accelerometer voice detection binary signals (e.g., 51 or 59). For some embodiments, block 33 includes combining one or more microphone voice detection binary signals with both of the accelerometer voice detection binary signals 51 and 59. In some cases, this combination of the audio and accelerometer signals may ensure that the earbud is determined to be in an ear of the user only when both types of signals display significant corresponding or correlated energy, such as the case when the user is speaking.

Block 33 may include combining voice detection binary signal output 41 (e.g., for one or more microphones) with output 51 and/or 59, such as using a logic AND gate or similar technology, known in the art. The combination may provide a high output (e.g., binary 1) when output 41 and output 51 and/or 59 are high; and a low output (e.g., binary 0) when one of them in not high. In some cases, the combination will be high when output 41 and output 51 are high. In some cases, the combination will be high when output 41 and output 59 are high. In some cases, the combination will be high when all three outputs are high. For example, any one or more microphones on a length to an earbud having accelerometer voice detection, may be selected for combination (e.g., to produce output 41). In some cases the microphone having the most frequent detection over time may be selected. In some cases a combination (e.g., average) of various microphones on the length may be selected. In other cases, a microphone selector can be used to compare the power of signals (which may be filtered to pass speech) from multiple microphones and select the microphone with the strongest power for performing the voice activity detection (VAD). In some cases, the microphone selector may be a separate block of FIG. 2A; or may be part of detector 28 and/or detector 29.

Also, according to embodiments, any one or both of accelerometer voice detection binary signals 51 and 59 may be selected for the combination. In some cases the binary signal having the most frequent detection over time may be selected. In some cases the binary signal having the most frequent VAD binary detections corresponding over time to the microphone VAD binary detections (e.g., output 41) may be selected. In some cases an accelerometer VAD detection selector can be used to compare signals 51 and 59 (and microphone) binary signals from multiple microphones and select the microphone with the strongest power for performing the voice activity detection (VAD). In some cases, the microphone selector may be a separate block of FIG. 2A; or may be part of detector 28 and/or detector 29.

Figure 4E:
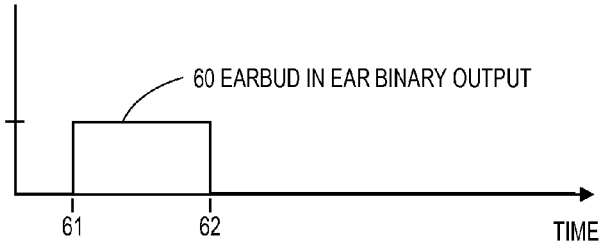
FIG. 4E shows a plot over time of a binary determination of whether an earbud is in an ear, based on combining binary output of accelerometer voice detection and binary output of microphone voice detection from one or more microphones.

FIG. 4E shows a determination of earbud in ear binary output plot 60 with respect to time, based on combining accelerometer voice detection binary signal output 51 and/or 59 with output 41 for one or more microphones. In some cases, when the binary output 41 and output 51 and/or 59 are high, such as shown between time 61 and 62, then output plot 60 provides a determination of earbud in ear binary high output of plot 60, such as detecting the earbud is positioned in an ear of the user. Time 61 is shown when output 41 becomes high, although output 51 and 59 were high previously. Time 62 is shown when output 51 and 59 drops to low, although output 41 continues to be high. Thus, the earbud in ear binary output is only high during the period between time 61 and 62. It is considered that in other embodiments, other logic can be used in place of the AND gate to provide a similar comparison.

It can be appreciated that the use of "high" and "low" signals herein are representative. According to embodiments, other logic (e.g., low as logic) or signal schemes can be used, such as to determine or provide the functions and results herein.

According to some embodiments, determining if the earbud is positioned in an ear of the user may be performed by determining a power between the front and rear microphone in each earbud; with or without considering the output of the accelerometer. In some embodiments, this determination takes the place of blocks 31 by using this ratio instead of the above noted microphone VAD. In some cases, this determination may take the place of block 32 by using this ratio instead of the above noted accelerometer VAD. In other cases, this may replace blocks 31-33 to provide the determination. Determining a power ratio between the front and rear microphone may include comparing the power in a specific frequency range to determine whether the front microphone power is greater than the rear microphone power by a certain percentage. The percentage (threshold) and the frequency region are dependent upon the size and shape of the earbuds and the positions of the microphones and thus may be selected based on experiments during use to provide detecting of the earbud only when the ratio displays a significant difference, such as the case when the user is speaking. This method is based on the observation that when the earbud is in the ear the power ratio in a specific high frequency range is different from the power ratio in that range when the earbud is out of the ear.

If the power ratio is below a threshold, this may indicate that the earbud is not in the ear, such as when the front microphone power is nearly the same as that of the rear microphone due to both microphones not being within the user's ear.

If the power ratio is above a threshold, this may indicate that the earbud is in the ear.

Some embodiments may include filtering outputs of the front and rear microphones of one earbud to pass frequencies useful for detecting a specific frequency region; then, comparing the front microphone power of the filtered front microphone output to the rear microphone power of the rear microphone output to determine a power ratio between the front and rear microphones. If the ratio is below or not greater than a predetermined percentage (e.g., a selected percentage as noted above), then determining that the one earbud is not in an ear of the user; and if the ratio is above or greater than the predetermined percentage, then determining that the one earbud is in an ear of the user. This may be repeated for the other earbud to determine if the other earbud is in the user's other ear.

According to embodiments, determining output 60, determining a power ratio between the front and rear microphone, and/or block 33 may be performed by earbud position detection circuitry. This circuitry may be part of detector 29. This circuitry may include hardware logic and/or software.

After block 33, process 30 continues to decision block 34, where it is determined whether only one of the earbuds is in the ear of the user. If only one earbud is determined to be in the user's ear, processing continues to block 35, otherwise processing continues to block 36.

At block 35, one or more microphones along the one length ending in the earbud in the user's ear are selected for beamforming or data input. In some cases, block 35 includes only selecting one or more microphones of the one ear bud in user's ear and along the length ending in the earbud in the user's ear for beamforming or data input. For some cases, only one or more microphones of the one length are selected for beamforming or data input. In some embodiments, the microphones noted above, as well as the microphones along the common wire are selected for beamforming data input. In some cases, block 35 includes not selecting the microphones of the one earbud not in the ears of the user, or of the one wired length ending with the one earbud not in the ears of the user, for the user beamforming data input. Some benefits of being able to make such a selection include more accurate detection of the existence of user speech, more accurate detection of the direction of user speech, and/or more accurate beamforming.

In some embodiments, block 35 also includes selecting only one or more microphones of the one earbud in the ears of the user, and of the one wired length ending with that one earbud, for user voice audio input. In some cases this may include selecting the same microphones for user voice audio input, as those selected for the user beamforming data input. This leads to more accurate detection of the user's voice.

At block 36, one or more microphones from both lengths are selected for beamforming or data input. In some embodiments, the microphones noted above, as well as the microphones along the common wire are selected for beamforming or data input.

In some embodiments, block 36 also includes selecting one or more microphones of both ear buds and both lengths for user voice audio input.

According to embodiments, selecting one or more of the microphones for user beamforming or data input, and/or blocks 34-36 may be performed by beamformer circuitry 13. This circuitry may include hardware logic and/or software.

It can be appreciated that the technology described herein may function regardless of whether a "left" or "right" earbud is positioned in the "left" or "right" ear of the user.

According to some embodiments, a process similar to process 30 may be performed based on microphone VAD output alone (e.g., see block 31 and/or embodiments that use microphones in the earbuds). In this case, block 32 is not included and the accelerometer output is not considered at block 33. According to some embodiments, a process similar to process 30 may be performed, based on accelerometer VAD output(s) alone. In this case, block 31 is not included and the microphone VAD output is not considered at block 33.

According to some embodiments, a process similar to process 30 may be performed for determining the position of just one single earbud, for example in headsets with a single earbud. In that case, data from only one earbud and one length (e.g., and possibly the common wire) would be considered the process.

It can be appreciated that determining that only one earbud is in the user's ear can provide benefits as compared to assuming that both earbuds are in the user's ears. More accurately determining that whether only one earbud is in the user's ear can also provide benefits. Such benefits may include more accurate detection of the existence of user speech, more accurate detection of the direction of user speech, and/or more accurate beamforming. Audio beamforming is a technique in which sounds (e.g., a user's voice or speech) received from two or more microphones are combined to enable the preferential capture of sound coming from certain directions. An audio device that uses audio beamforming can include an array of two or more closely spaced, omnidirectional microphones linked to a processor. The processor can then combine the signals captured by the different microphones to generate a single output to isolate a sound from background noise. In some cases, a beamformer processor receives inputs from two or more microphones in the device 1 and performs audio beamforming operations. A beamformer processor may combine the signals captured by two or more microphones to generate a single output to isolate a sound from background noise. For example, in delay-and-sum beamforming each of the microphones independently receive/sense a sound and convert the sensed sound into correspond sound signals. The received sound signals are delayed appropriately to be in phase and summed to reduce the background noise coming from the undesired directions. For example, the beamformer processor may use the inputs received from the microphones to produce a variety of audio beamforming spatial directivity response patterns, including cardioid, hyper-cardioid, and sub-cardioid patterns. The patterns can be fixed or adapted over time, and may even vary by frequency (e.g., to best beamform to detect a user's voice or speech).

For example, we return to FIGS. 1A-B for illustrations of how accurately determining that only one earbud is in the user's ear can provide more accurate detection of the existence of user speech, more accurate detection of the direction of user speech, and/or more accurate beamforming. FIG. 1A shows a situation where both earbuds 9 and 10; both lengths 7 and 8; and wire 6 oriented "upward" by having their top ends positioned upwards (e.g., with respect to the users head). However, while FIG. 1B shows earbud 10, length 8, and wire 6 oriented "upward" having their tops ends positioned upwards; it also shows earbud 9 and length 7 oriented "downward" by having their tops ends positioned downwards (e.g., with respect to the users head). It can be appreciated that the descriptions for FIG. 1B may also include situations when earbud 9, length 7, and wire 6 are oriented "upward"; while earbud 10 and length 8 are oriented "downward". Descriptions of being oriented "downward" may include various orientations of one earbud and one length where the earbud is not inserted in an ear of the user.

In some cases, the description of oriented "upward" and "downward" may apply regardless of the orientation of the user's head, such as where "upward" and "downward" describe orientations of between 90 and 180 degrees. In some cases, the description of oriented "upward" and "downward" may apply where one earbud and one length is oriented oppositely, sideways or not in the same directional as the other earbud and length.

It can be appreciated that knowing the position or orientation of the earbuds and lengths provides for improved detection of user speech and/or to beamforming. For example, if a process, software and/or circuitry for performing user speech detection and/or to beamforming assumes that both earbuds and length are oriented upwards, as shown in FIG. 1A, then the situation shown in FIG. 1B may provide erroneous or less accurate directional information with respect to microphones (and accelerometers) on length 7 and earbud 9. In cases when one earbud and length are oriented sideways (e.g., 90 degrees with respect to being oriented upwards) the directional information from microphones and accelerometer on length 7 and earbud 9 (e.g., microphones 16, 18, and 22; and accelerometer 14) and may provide information that is erroneous or less accurate by 90 degrees. Similarly, when one earbud and length are oriented downwards (e.g., 180 degrees with respect to being oriented upwards) the directional information from the downward microphones and accelerometer may provide information that is erroneous by 180 degrees. Thus, by knowing whether one or both earbuds are inserted in ears of the user, it is possible to correct situations where the directional information from the sideways or downward microphones and accelerometer is erroneous by between 90 and 180 degrees.

Moreover, if a process, software and/or circuitry for performing user speech detection and/or to beamforming assumes that both earbuds are inserted in the user's ears, then the situation shown in FIG. 1B may provide less reliable or less accurate directional information with respect to microphones (and accelerometers) on length 7 and earbud 9 since they are likely to experience more noise and less speech volume because they are likely farther away from the user's mouth in this case (e.g., farther than a microphone on a length to an earbud positioned in an ear).

Figure 5:
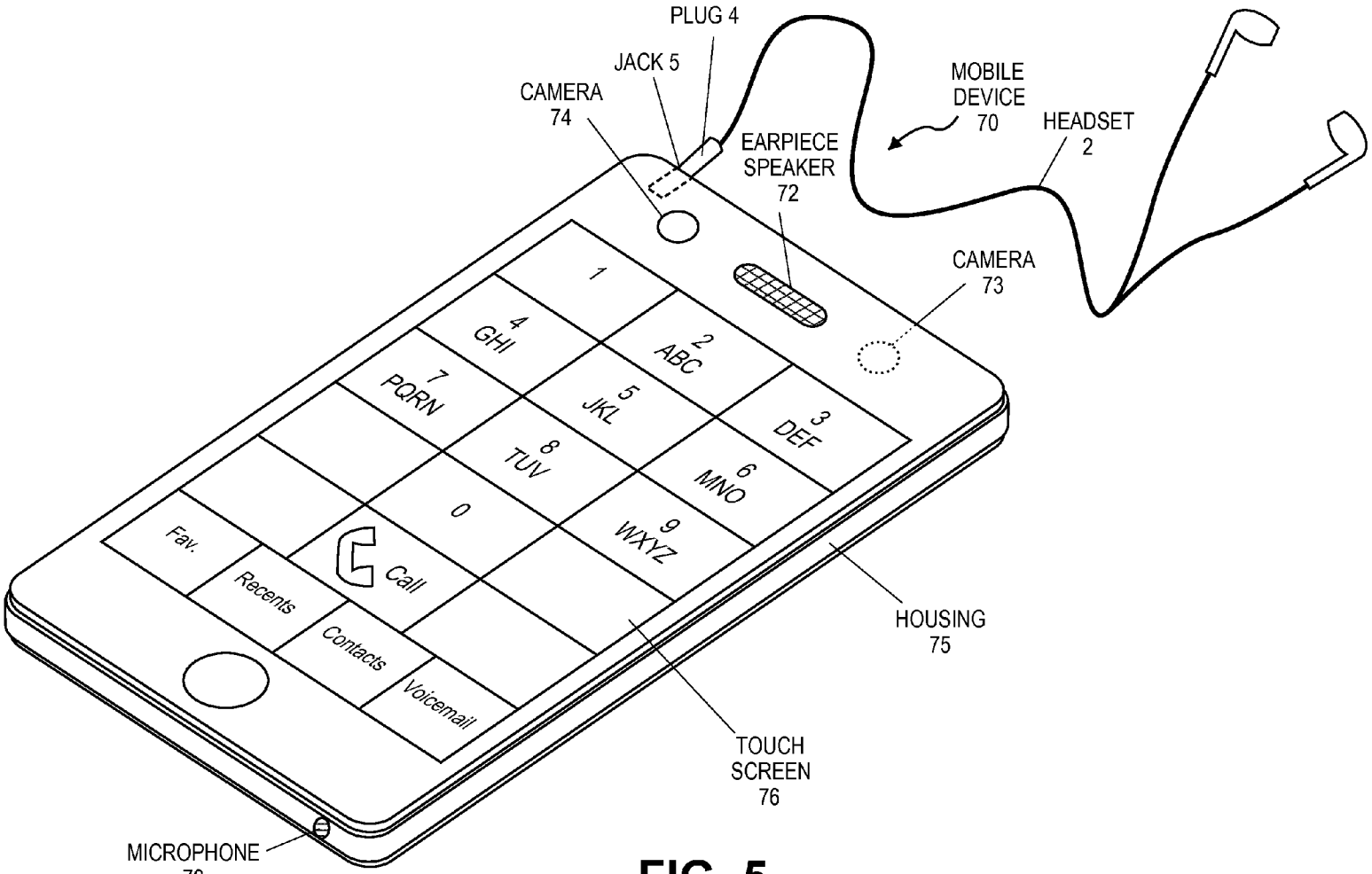
FIG. 5 shows an example mobile device with which embodiments for determining whether earbuds of a headset are inserted in ears of a user can be implemented.

According to embodiments, audio device 1 may be portable or stationary. FIG. 5 shows an example mobile device 70 and circuitry in or with which embodiments for determining whether earbuds of a headset are inserted in ears of a user can be implemented. In some cases, device 70 is an embodiment of device 1. The mobile device 70 may be a personal wireless communications device (e.g., a mobile telephone) that allows two-way real-time conversations (generally referred to as calls) between a near-end user that may be holding the device 70 against her ear, or using headset 2 (e.g., with a plug inserted into jack 5 of device 70) or using device 1 in speaker mode, and a far-end user. This particular example is a smart phone having an exterior housing 75 that is shaped and sized to be suitable for use as a mobile telephone handset. There may be a connection over one or more communications networks between the mobile device 70 and a counterpart device of the far-end user. Such networks may include a wireless cellular network or a wireless local area network as the first segment, and any one or more of several other types of networks such as transmission control protocol/internet protocol (TCP/IP) networks and plain old telephone system networks.

The mobile telephone 70 of FIG. 5 includes housing 75, touch screen 76, microphone 79, ear-piece speaker 72, and jack 5. During a telephone call, the near-end user may listen to the call using speakers of headset 2 (e.g., with a plug inserted into jack 5 of device 70) or earpiece speaker 72 located within the housing of the device and that is acoustically coupled to an acoustic aperture formed near the top of the housing. The near-end user's speech may be picked up by microphones of headset 2. The circuitry may allow the user to listen to the call through wired headset 2 that is connected to a jack 5 of mobile device 70. Using headset 2 may include embodiments described herein for detecting whether earbuds of the headset are in ears of the user, selecting microphones for beamforming input, and performing beamforming using the selected inputs. The call may be conducted by establishing a connection through a wireless network, with the help of RF communications circuitry coupled to an antenna that are also integrated in the housing of the device 70.

A user may interact with the mobile device 70 by way of a touch screen 76 that is formed in the front exterior face or surface of the housing. The touch screen may be an input and display output for the wireless telephony device. The touch screen may be a touch sensor (e.g., those used in a typical touch screen display such as found in an iPhone™ device by Apple Inc., of Cupertino Calif.). As an alternative, embodiments may use a physical keyboard may be together with a display-only screen, as used in earlier cellular phone devices. As another alternative, the housing of the mobile device 70 may have a moveable component, such as a sliding and tilting front panel, or a clamshell structure, instead of the chocolate bar type depicted.

In some cases, determining whether one or both earbuds are inserted in ears of the user, may be performed by audio device 1, by the headset, or by a combination of the two. According to embodiments, detector 28 and/or detector 29 are located in device 1. In these cases, signals described above for headset 2 are communicated between device 1 and headset 2 using jack 5 and plug 4. In other cases the detection may be made by circuitry of the headset. In this case, detector 28 and/or detector 29 may be located in the headset, and the headset may perform beamfoming, or may signal whether the earbuds are in ears of the user to the attached audio device which then performs the beamforming.

In some cases, the processes, devices and functions of detection of whether one or both earbuds are inserted in ears of the user, may be implemented in circuitry or hardware located within the headset, within a computing device, within an automobile, or within an electronic audio device as described herein. Such implementations may include hardware circuitry (e.g., transistors, logic, traces, etc), software, or a combination thereof to perform the processes and functions; and include the devices as described herein.

According to some embodiments, determining whether earbuds are in ears of the user, or detector 29, includes or may be embodied within a computer program stored in a storage medium, such as a non-transitory or a tangible storage medium. Such a computer program (e.g., program instructions) may be stored in a machine (e.g. computer) readable non-volatile storage medium or memory, such as, a type of disk including floppy disks, optical disks, CD-ROMs, and magnetic-optical disks, read-only memories (ROMs), erasable programmable ROMs (EPROMs), electrically erasable programmable ROMs (EEPROMs), magnetic or optical cards, magnetic disk storage media, optical storage media, flash memory devices, or any type of media suitable for storing electronic instructions. The processor may be coupled to a storage medium to execute the stored instructions. The processor may also be coupled to a volatile memory (e.g., RAM) into which the instructions are loaded from the storage memory (e.g., non-volatile memory) during execution by the processor. The processor and memory(s) may be coupled to an audio codec as described herein. In some cases, the processor may perform the functions of detector 29. The processor may be controlled by the computer program (e.g., program instructions), such as those stored in the machine readable non-volatile storage medium.

While certain embodiments have been described and shown in the accompanying drawings, it is to be understood that such embodiments are merely illustrative of and not restrictive on the broad invention, and that the invention is not limited to the specific constructions and arrangements shown and described, since various other modifications may occur to those of ordinary skill in the art. For example, although the audio device 1 depicted in the figures may be a portable device, a telephone, a cellular telephone, a smart phone, digital media player, or a tablet computer, the audio device may alternatively be a different portable device such as a laptop computer, a hand held computer, or even a non-portable device such as a desktop computer or a home entertainment appliance (e.g., digital media receiver, media extender, media streamer, digital media hub, digital media adapter, or digital media renderer). The description is thus to be regarded as illustrative instead of limiting.

What is claimed is:

1. A method for operating a headset, the method comprising:

detecting an audio signal through at least one of a plurality of microphones of the headset having a plurality of earbuds including a first earbud and a second earbud;

detecting the audio signal through at least one of a plurality of accelerometers that are not the same items as the microphones and that are located in the earbuds by (1) high pass filtering at least one output of the at least one of the plurality of accelerometers to pass frequencies of audible sound and (2) generating a binary signal that indicates detection of frequencies of audible sound in the at least one output;

based on the detections of the audio signal through the at least one of the microphones and through the at least one of the accelerometers, determining whether one or two of the first and second earbuds are in an ear of a user, wherein determining includes using the binary signal; and if it is determined that only one earbud is in an ear of the user, selecting one or more microphones of the only one earbud, for user beamforming data input.

2. The method of claim 1, wherein the one or more microphones selected for user beamforming data input excludes microphones of the one earbud determined not to be in the ears of the user.

3. The method of claim 1, further comprising, if it is determined that two earbuds are in ears of the user, selecting the microphones of the two earbuds for the user beamforming data input.

4. The method of claim 1, wherein detecting the audio signal through at least one of a plurality of accelerometers comprises performing accelerometer voice activity detection comprising:

one of:

converting a plurality of direction vibration signals of the high pass filtered at least one output of the at least one of a plurality of accelerometers into a power signal to determine an amount of vibration of the at least one of a plurality of accelerometers in each dimension;

performing a normalized cross-correlation between a pair of orthogonal accelerometer output signals of the high pass filtered at least one output of the at least one of a plurality of accelerometers to determine an amount of vibration of the at least one of a plurality of accelerometers in two dimensions; or computing a normalized cross-correlation between three pairs of orthogonal accelerometer output signals of the high pass filtered at least one output of the at least one of a plurality of accelerometers to determine an amount of vibration of the at least one of a plurality of accelerometers in three dimensions, and selecting a pair of orthogonal accelerometer output signals with the strongest cross correlation.

5. The method of claim 4, wherein detecting the audio signal through at least one of a plurality of microphones comprises:

performing microphone voice activity detection using the audio signal detected at the at least one of a plurality of microphones.

6. The method of claim 4, wherein determining comprises combining the accelerometer voice activity detection with microphone voice activity detection from any one or more of the microphones.

7. The method of claim 4, wherein detecting the audio signal through at least one of a plurality of microphones includes filtering to pass only frequencies of sound for speech; and wherein detecting the audio signal through at least one accelerometer includes detecting user speech vibrations in the accelerometer.

8. The method of claim 1, wherein detecting the audio signal through at least one accelerometer includes:

cross correlating two orthogonal signals of the high pass filtered at least one output of the at least one of a plurality of accelerometers to produce a normalized cross correlated output signal; and detecting the audio signal while the normalized cross correlated output signal within a short delay interval exceeds a threshold.

9. The method of claim 8, wherein detecting the audio signal through at least one accelerometer includes:

removing cross talk in the accelerometer signals resulting from output of an earbud speaker; and wherein detecting the audio signal while the normalized cross correlated output signal exceeds a threshold includes:

computing a maximum of the normalized cross correlated output signal during a predetermined short delay interval of time.

10. An apparatus to detect whether at least one of a plurality of earbuds of a headset including a first earbud and a second earbud is in an ear of a user, the apparatus comprising:

microphone voice detection circuitry to detect an audio signal through at least one of a plurality of microphones in the at least one of the earbuds;

accelerometer voice detection circuitry to detect the audio signal through at least one of a plurality of accelerometers that are not the same items as the microphones and that are located in the earbuds by (1) high pass filtering at least one output of the at least one of the plurality of accelerometers to pass frequencies of sound and (2) generating a binary signal that indicates detection of frequencies of audible sound in the at least one output; and earbud position detection circuitry to, based on both of the detections of the audio signal through the at last one of the microphones and through the at least one of the accelerometers, determine whether one or two of the first and second earbuds are in an ear of the user, wherein determining includes using the binary signal.

11. The apparatus of claim 10, wherein the accelerometers are voice vibration detection accelerometers; and wherein the apparatus is an electronic audio computing device comprising:

communication circuitry that communicates with the headset, wherein the communication circuitry has corresponding channels to receive signals from the microphones and accelerometers, and for sending signals to speakers in the earbuds.

12. The apparatus of claim 10 further comprising beamforming circuitry to, if it is determined that only one earbud of the at least one of the earbuds is in an ear of the user, select one or more microphones of the one earbud in the ears of the user, for user beamforming data input.

13. The apparatus of claim 10, the accelerometer voice detection circuitry further comprising accelerometer voice activity detection circuitry to:

one of:

convert a plurality of direction vibration signals of the high pass filtered at least one output of the at least one of a plurality of accelerometers into a power signal to determine an amount of vibration of the at least one of a plurality of accelerometers in each dimension;

perform a normalized cross-correlation between a pair of orthogonal accelerometer output signals of the high pass filtered at least one output of the at least one of a plurality of accelerometers to determine an amount of vibration of the at least one of a plurality of accelerometers in two dimensions; or compute a normalized cross-correlation between three pairs of orthogonal accelerometer output signals of the high pass filtered at least one output of the at least one of a plurality of accelerometer to determine an amount of vibration of the at least one of a plurality of accelerometer in three dimensions, and selecting a pair of orthogonal accelerometer output signals with the strongest cross correlation.

14. The apparatus of claim 13, the microphone voice detection circuitry further comprising microphone voice activity detection circuitry to perform microphone voice activity detection using the audio signal detected at the at least one of a plurality of microphones of the headset.

15. The apparatus of claim 13, the earbud position detection circuitry further comprising combining circuitry to combine the accelerometer voice activity detection with microphone voice activity detection from any one or more of the microphones.

16. The apparatus of claim 10, the accelerometer voice detection circuitry further comprising circuitry to:

compute normalized cross correlation of two orthogonal signals of the high pass filtered at least one output of the at least one of a plurality of accelerometers; and detect the audio signal while a maximum on a short delay interval of the normalized cross correlated output signal exceeds a threshold.

17. A non-transitory computer-readable medium storing data and instructions to cause a programmable processor to perform operations for operating a headset, the operations comprising:

detecting an audio signal through at least one of a plurality of microphones of the headset having a plurality of earbuds including a first earbud and a second earbud;

detecting the audio signal through at least one of a plurality of accelerometers that are not the same items as the microphones and that are located in the earbuds by (1) high pass filtering at least one output of the at least one of the plurality of accelerometers to pass frequencies of audible sound and (2) generating a binary signal that indicates detection of frequencies of audible sound in the at least one output;

based on the detections of the same audio signal through the at last one of the microphones and through the at least one of the accelerometers, determining whether one or two of the first and second earbuds are in an ear of the user;

based on the detections of the same audio signal through the at least one of the microphones and through the at least one of the accelerometers, determining whether one or two of the first and second earbuds are in an ear of the user, wherein determining includes using the binary signal; and if it is determined that only one earbud is in an ear of the user, selecting one or more microphones of the only one earbud, for user beamforming data input; and if it is determined that both earbuds are in the ears of the user, selecting one or more microphones for user beamforming data input.

18. The medium of claim 17, wherein detecting the audio signal through at least one of the microphones comprises:

performing microphone voice activity detection using the audio signal detected at the at least one of a plurality of microphones;

and wherein detecting the audio signal through at least one of the accelerometers comprises performing accelerometer voice activity detection comprising:

one of:

converting a plurality of direction vibration signals of the high pass filtered least one output of the at least one of a plurality of accelerometers into a positive power signal to determine an amount of vibration of the at least one of a plurality of accelerometer in each dimension;

performing a normalized cross-correlation between a pair of orthogonal accelerometer output signals of the high pass filtered at least one output of the at least one of a plurality of accelerometers to determine an amount of vibration of the at least one of a plurality of accelerometers in two dimensions; or combining the accelerometer voice activity detection with microphone voice activity detection from any one or more of the microphones.

19. The medium of claim 17, wherein detecting the audio signal through at least one accelerometer includes:

computing cross correlation of two orthogonal signals of the high pass filtered at least one output of the at least one of a plurality of accelerometers to produce a normalized cross correlation output signal; and detecting the audio signal while the normalized cross correlated output signal exceeds a threshold.

20. The method of claim 1, wherein determining whether one or two of the first and second earbuds are in an ear of the user includes determining whether the outputs of the front and rear microphones display significant corresponding or correlated energy.

21. The method of claim 1, determining whether one or two of the first and second earbuds are in an ear of the user includes:

identifying speech from the user using the output of one of the plurality of microphones;

identifying speech from the user using the output of one of the plurality of accelerometers;

and when speech from the user is identified in the output of the microphone and in the output of the accelerometer, determine that an earbud is in the ear of the user.

22. A method for operating a headset, the method comprising:

detecting an audio signal through at least one of a plurality of microphones of the headset having a plurality of earbuds including a first earbud and a second earbud;

detecting the audio signal through at least one of a plurality of accelerometers that are not the same items as the microphones and that are located in the earbuds by (1) high pass filtering at least one output of the at least one of the plurality of accelerometers to pass frequencies of audible sound and (2) generating a binary signal that indicates detection of frequencies of audible sound in the at least one output;

based on the detections of the audio signal through the at last one of the microphones and through the at least one of the accelerometers, determining whether one or two of the first and second earbuds are in an ear of the user, wherein determining includes using the binary signal, and wherein detecting the audio signal through at least one of the accelerometers comprises performing accelerometer voice activity detection comprising:

filtering out a direct current (DC) power level output of the at least one of a plurality of accelerometers;

converting a plurality of direction vibration signals of the at least one of a plurality of accelerometers into a power signal to determine an amount of vibration of each of the at least one of a plurality of accelerometers; and if it is determined that only one earbud is in an ear of the user, selecting one or more microphones of the only one earbud, for user beamforming data input.

23. The method of claim 22, wherein detecting the audio signal through the at least one of a plurality of accelerometers includes filtering to pass only frequencies of sound for speech.

24. The method of claim 1, further comprising:

detecting the audio signal through at least another of the plurality of accelerometers that are located in another of the earbuds by (1) high pass filtering at least another output of the at least another of the plurality of accelerometers to pass frequencies of audible sound and (2) generating another binary signal that indicates detection of frequencies of audible sound in the at least another output;

based on the detections of the audio signal through the at least one of the microphones, through the at least one of the accelerometers, and through the at least another of the accelerometers, determining whether one or two of the first and second earbuds are in ears of the user, wherein determining includes using the binary signal and using the another binary signal; and if it is determined that only one earbud is in an ear of the user, selecting one or more microphones of the only one earbud, for user beamforming data input.

25. The apparatus of claim 10, further comprising:

the accelerometer voice detection circuitry detecting the audio signal through at least another of the plurality of accelerometers that are located in another of the earbuds by (1) high pass filtering at least another output of the at least another of the plurality of accelerometers to pass frequencies of audible sound and (2) generating another binary signal that indicates detection of frequencies of audible sound in the at least another output;

based on the detections of the audio signal through the at least one of the microphones, through the at least one of the accelerometers, and through the at least another of the accelerometers, the earbud position detection circuitry determining whether one or two of the first and second earbuds are in ears of the user, wherein determining includes using the binary signal and using the another binary signal; and if it is determined that only one earbud is in an ear of the user, selecting one or more microphones of the only one earbud, for user beamforming data input.

26. The medium of claim 17, the operations further comprising:

detecting the audio signal through at least another of the plurality of accelerometers that are located in another of earbuds by (1) high pass filtering at least another output of the at least another of the plurality of accelerometers to pass frequencies of audible sound and (2) generating another binary signal that indicates detection of frequencies of audible sound in the at least another output;

based on the detections of the audio signal through the at least one of the microphones, through the at least one of the accelerometers, and through the at least another of the accelerometers, determining whether one or two of the first and second earbuds are in ears of the user, wherein determining includes using the binary signal and using the another binary signal; and if it is determined that only one earbud is in an ear of the user, selecting one or more microphones of the only one earbud, for user beamforming data input.

* * * * *